United States Patent [19]

Dawson

[11] 4,182,153

[45] Jan. 8, 1980

[54] WATCH SPRING BAR KIT

[76] Inventor: Wayne G. Dawson, 757 3rd St., McFarland, Calif. 93250

[21] Appl. No.: 868,066

[22] Filed: Jan. 9, 1978

Related U.S. Application Data

[62] Division of Ser. No. 760,965, Jan. 20, 1977, Pat. No. 4,090,606.

[51] Int. Cl.[2] ..... B21D 7/00

[52] U.S. Cl. ..... 72/414; 59/7; 72/475

[58] Field of Search ..... 72/414, 415, 475; 81/6; 24/265 D; 224/4 E; 63/22; 59/7, 80

[56] References Cited

U.S. PATENT DOCUMENTS

| | | | |
|---|---|---|---|
| 64,585 | 5/1867 | Schubeus | 72/414 |
| 1,249,017 | 12/1917 | Brunkhurst | 73/426 |
| 1,998,969 | 4/1935 | Schauer | 73/426 |
| 2,042,945 | 6/1936 | Lemay | 73/426 |
| 4,004,447 | 1/1977 | Wantling | 72/414 |

FOREIGN PATENT DOCUMENTS

| | | | |
|---|---|---|---|
| 393780 | 4/1924 | Fed. Rep. of Germany | 72/415 |
| 571401 | 2/1933 | Fed. Rep. of Germany | 72/426 |

*Primary Examiner*—Francis S. Husar
*Assistant Examiner*—Gene P. Crosby
*Attorney, Agent, or Firm*—Wills, Green & Mueth Law Corporation

[57] ABSTRACT

A kit for use in selecting a proper spring bar for use in connecting a watch band to a watch case, and including a container holding a supply of spring bars of different lengths and types, a gauge part having portions of different widths adapted to be received within and measure differently dimensioned recesses or gaps in a watch case into which a band is to be connected, and coding markings on the gauge part and bars indicating which bar in the container will fit a particular case which has been measured by the gauge part.

4 Claims, 8 Drawing Figures

FIG. 1
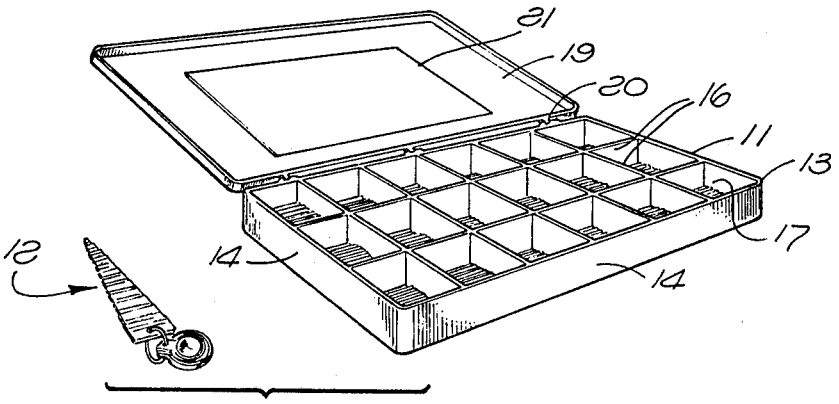
FIG. 2
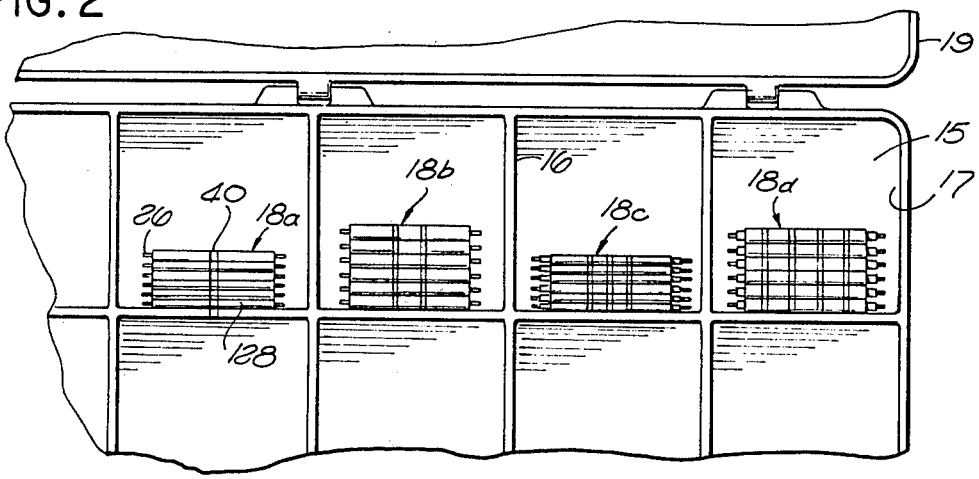
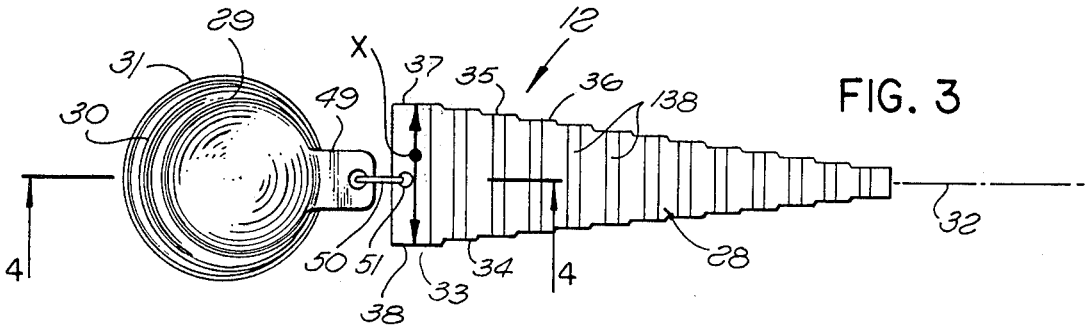
FIG. 3
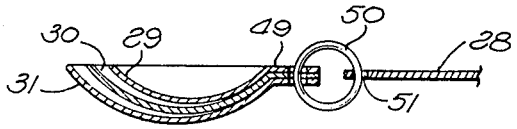
FIG. 4

FIG. 5
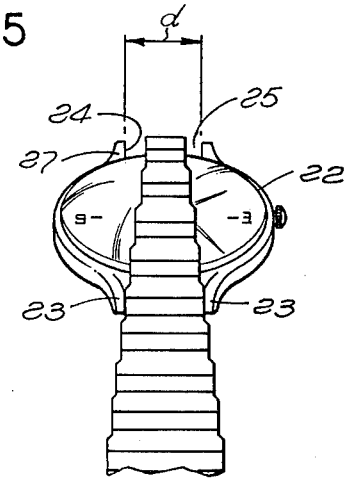
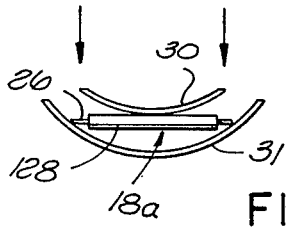
FIG. 7
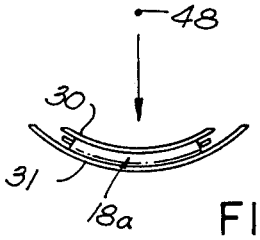
FIG. 8
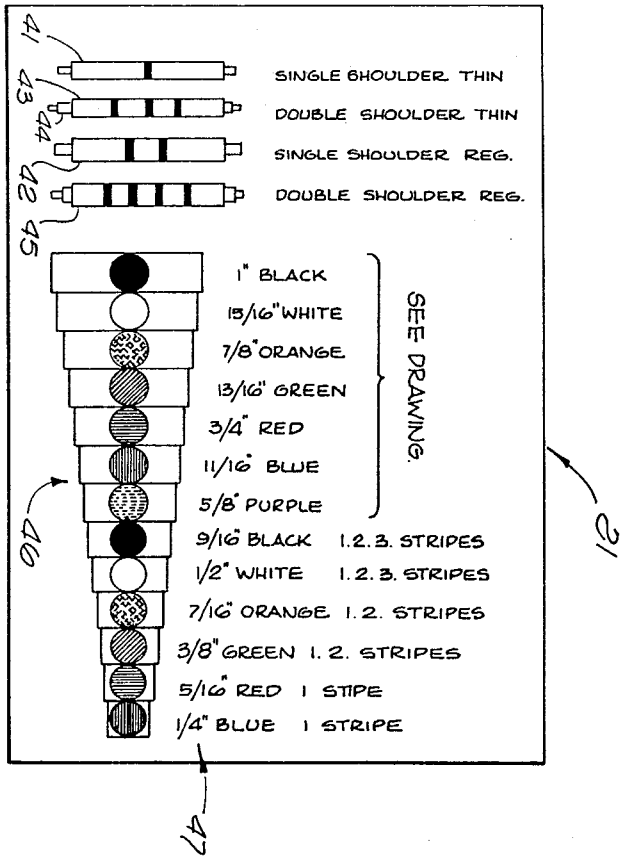
FIG. 6

WATCH SPRING BAR KIT

This is a division of application Ser. No. 760,965, filed Jan. 20, 1977, now U.S. Pat. No. 4,090,606 issued May 23, 1978.

BACKGROUND OF THE INVENTION

This invention relates to improved kits for facilitating the selection of a particular watch band attaching spring bar to fit a certain watch case.

The spring bars or pins which are utilized for detachably connecting a strap to a watch case are manufactured in a number of different lengths and types, to fit cases and bands of various different designs. For every band width, there must of course be provided a particular corresponding length of spring bar, and for each such length of bar there are available bars of two different diameters. Also, in each such diameter there are available bars or pins having two shoulders at each end or a single shoulder at each end. The various possible combinations of these different features can thus run into a very substantial number of bar types.

In order to be prepared for any type of band repair or replacement, a jeweler must stock a large number of these different sizes and types of band retaining spring bars. When a customer requests a spring bar, the jeweler may find it necessary to spend a very substantial period of time in measuring the recess in the watch case to which the band is to be connected, and then sorting through various sizes and types of spring bars to arrive at exactly the right bar for the particular situation.

SUMMARY OF THE INVENTION

The present invention provides a unique kit which can be used for very rapidly determining the right size of spring bar to be employed with a particular watch case, and then quickly selecting exactly the right bar from a supply of different sizes and types. The kit includes a container for holding bars of different sizes and constructions, and gauge means to be positioned adjacent the watch case and measure the width of the recess or gap into which the end of a watch band is to be connected. The gauge means carry markings for identifying the different recess widths, and the spring bars are provided with corresponding markings keyed to those of the gauge means and by which a person may quickly select the appropriate length of spring bar from the container. The coding markings desirably take the form of colors printed on the gauge means and spring bars with the colors on the bars preferably being applied in the form of different numbers of stripes for indicating different types of bars of a common length. More particularly, the stripes may indicate whether the bars are of 'regular' diameter or a smaller 'thin' diameter and whether the bars are of the single shoulder or two shoulder type.

In conjunction with the discussed coding markings on the gauge and bars, I desirably utilize also a reference chart or charts, which may be carried by the container, and which indicate the significance of the different colors and the significance of the different numbers of stripes on the bars.

An additional feature of the invention relates to the provision of means for bending the bars to a curved condition when desired. For this purpose, I employ a plurality of superimposed concavely curved spoon like elements between which an initially straight spring bar may be positioned, and by which the bar can be bent to a curvature corresponding to that of the concave elements when those elements are pressed together against the bar.

BRIEF DESCRIPTION OF THE DRAWING

The above and other features and objects of the invention will be better understood from the following detailed description of the typical embodiment illustrated in the accompanying drawing in which:

FIG. 1 is a perspective representation of a kit constructed in accordance with the invention;

FIG. 2 is an enlarged fragmentary plan view of some of the compartments in the container within which the supplies of spring bars are contained;

FIG. 3 is an enlarged plan view of the gauge part and bending elements of the kit;

FIG. 4 is a section taken on line 4—4 of FIG. 3;

FIG. 5 shows the manner in which the gauge part is utilized from measuring the width of the band receiving recess of a watch case;

FIG. 6 illustrates the reference chart which is carried by the cover of the container of FIG. 1; and FIGS. 7 and 8 illustrate the manner in which the bending tools can be used to curve a spring bar.

DESCRIPTION OF THE PREFERRED EMBODIMENT

The kit 10 illustrated in FIG. 1 includes a container 11 and a measuring and bending assembly 12. Container 11 preferably takes the form of a rectangular horizontally extending tray 13 having peripheral walls 14 extending upwardly from a bottom 15, and having partitions 16 dividing the tray into a number of compartments 17 within which different sizes and types of spring bars **18*a*, 18*b*, 18*c*, 18*d*, etc. are received. The top of the tray 11 is closed by a cover 19 which can be hinged to tray 11 at 20 to swing between a closed position overlying compartment 17 and the open position of FIG. 1. At its underside or inner side, cover 19 carries a sheet of paper 21 suitably adhered to the cover and carrying markings forming a chart for use in selecting different ones of the spring bars 18*a*, 18*b***, etc.

In FIG. 5, there is represented at 22 a watch case to which a strap is to be connected by means of one of the spring bars or pins **18*a*, 18*b*, etc. of FIG. 2. As will be understood, the case 22 has at each of its sides a pair of projections 23 having parallel shoulders 24 at their inner sides facing one another and spaced apart a distance d to provide a gap 25 of a width corresponding to that of the end portion of a watch strap which is to be connected to the case. To retain the strap, one of the pins 18*a*, 18*b*, etc. is selected which has an effective length to fit within the recess or gap 25 of width d formed between shoulders 23, and the spring pressed pins 26 carried at the opposite ends of the spring bar are received within small bores or openings 27 formed in shoulders 24 to releasably retain the bars in their position of interconnection to the case. Each of the bars of course consists of a main tubular body 128 containing a spring which yieldingly urges the end pins 26 in opposite directions relative to body 128**.

As best seen in FIGS. 3 and 4, the measuring and bending assembly 12 includes a gauge part 28 and a number of bending elements 29, 30 and 31. The gauge part 28 may be formed of flat sheet metal and be elongated in the direction of a longitudinal axis 32. Extending transversely of this longitudinal axis the gauge 28 may be considered as divided into a series of transverse regions or portions 33, 34, 35, 36, etc., each of which is defined at its opposite sides by two parallel side edges 37 and 38, all desirably extending parallel to longitudinal axis 32. Each of the successive regions 33, 34, 35, 36, etc. has a characteristic width dimension x, between its opposite side edges 37 and 38, which corresponds to one of the various standard widths d (FIG. 5) of the watch band receiving recesses or gaps in conventional watches. The width of each of the regions 34, 35, 36, etc. is slightly less than the width of the preceding region 33, 34, 35, etc., to cover all of the standard case recess dimensions. Also, there is painted or printed onto the upper surface of each of the regions 33, 34, 35, etc. a band of color 138 which is characteristic of and identifies the width dimension of that particular region. All of these colors of the different regions from 1" down to 5/16" are different, with the colors then repeating in the same sequence from 9/16", to ¼", so that any two sizes having the same color differ by almost an inch in length, and are readily distinguishable to enable easy selection of a particular proper bar from container 11.

For each of the regions 33, 34, 35, etc. of gauge 28, there may be provided in container 11 four different types of spring bars, all of the same nominal length. These four types of bars are contained in four different compartments 17 of tray 11 and are all striped with the characteristic key color associated with that particular length of bar, but have different numbers of stripes of that color to indicate the differences in structure of the different bars. As an example, assume that the region 36 of gauge 28 is green and has a width of 13/16 of an inch. This portion of the gauge will thus be received closely within the recess 25 of a watch having an approximately 13/16 inch spacing at the location indicated d in FIG. 5. The four compartments 17 containing spring bars **18*a*, 18*b*, 18*c*, and 18*d* of FIG. 2 may all contain spring bars of this nominal 13/16 length, with stripes 40 painted on all of these of the same green color which designates the region 36 of gauge 28. However, the bars 18*a* within one of the compartments 17 may have single central green stripes painted thereabout, indicating that these bars are of the 'single shoulder thin' type. This type of bar is represented at 41 in the chart 21 of FIG. 6, with the words "single shoulder" indicating that the spring pressed pins 26 at the ends of the device each have only a single shoulder, while the word "thin" indicates that the diameter of the body of the bar is relative small. Similarly, the use of two stripes 40 about each of the bars 18*b* indicates that these bars are of the "single shoulder, regular" type, that is, they are the same as the bars 18*a*, but of a somewhat larger diameter. This is brought out at 42 in chart 21. The bars 18*c* have three stripes painted thereabout, and as indicated at 43 in chart 21 are of "double shoulder, thin" type. The words "double shoulder" refer to the fact that the pins 26 at the ends of these bars have a second shoulder at the locaton 44 for engagement with the shoulder 24 of the case. The bars 18*d* are of the "double shoulder, regular" type, as represented at 45 on chart 21. The stripes in chart 21 may be of a neutral color such as black, and merely indicate the significance of the number of stripes in each case, while the color of the stripes can be indicated by the provision of a series of colored dots 46 in chart 21, with the nominal lengths represented by those colors being given at 47. For each of these other lengths of bar, there may be provided four separate compartments corresponding to those containing bars 18*a*, 18*b*, 18*c*, and 18*d***, or if desired there may in some cases be fewer such compartments where a particular size band is not very popular.

Some of the shorter lengths of bars may be too short to have painted thereon as many as four separate stripes. For this reason, these shorter bars may have only one, two or three stripes, with the significance of these stripes being slightly altered and known by the user of the kit. For example, as indicated by the FIG. 6 chart, the 9/16" and 1/2" bars may have a maximum of three stripes, with one stripe representing a single shoulder thin body, two stripes representing a single shoulder regular body, and three stripes representing a double shoulder, thin or regular body. Similarly, for 7/16" and 3/8" bars, one stripe may represent a single shoulder bar, either thin or regular body, and two stripes may represent a double shoulder bar, either thin or regular body. For 5/16" and ¼" bars, one stripe may be used for all four types.

The parts 29, 30, and 31 may be essentially spoon shaped and concavely curved. Desirably, each of these elements is curved spherically, and is circular in plan view as seen in FIG. 3. The part 30 is larger in diameter than upper part 29 in plan view and has a larger radius of curvature (FIG. 8), and the lower part 31 is still larger in plan view diameter and radius of curvature, so that all three of the parts will nest together as shown. Handle tabs 49 project laterally from parts 29, 30, and 31, and contain apertures which receive a common mounting ring 50 which extends through an opening 51 in an end of gauge 28 to movably attach parts 29,30, and 31 to the gauge.

In use, when a jeweler or other person wishes to select a proper spring bar for a particular watch case, he first inserts the gauge element into the recess or gap 25 formed at one side of the case, as seen in FIG. 5, and moves the gauge 28 longitudinally (upwardly in FIG. 5) until a particular one of the regions 33, 34, 35, etc. exactly fits within the gap 25. The color marking 38 on that particular region then indicates the length of bar which must be employed. The compartments containing bars striped with that particular color are found in tray 11, and the proper number of stripes of that color are selected to give either a single or double shoulder as desired, and a thin or regular diameter as desired. When a bar having the proper number of stripes of the correct color is found, it will fit within the previously measured recess or gap 25 without further difficulty in making a selection.

If the watch is of a type requiring use of a curved. spring bar, a bar of appropriate length is selected and inserted between two of the spoon shaped parts 29, 30, or 31, in the condition illustrated in FIG. 7, and these two parts are then pressed together to the condition represented in FIG. 8, to bend the bar **18*a* or the like to a curvature corresponding to that of the engaged bending elements. The parts 29, 30, and 31 are so designed that any successive ones of these parts when in the condition of FIG. 8, with a curved spring bar therebetween, will have approximately a common center of spherical curvature 48**.

While a certain specific embodiment of the present invention has been disclosed as typical, the invention is of course not limited to this particular form, but rather is applicable broadly to all such variations as fall within the scope of the appended claims.

I claim:

1. The method of bending a watch spring bar that comprises:

positioning said spring bar between two superimposed concavely curved elements, each of which has a different radius of curvature; and pressing said elements toward one another and against the spring bar therebetween with a force bending the spring bar to a curvature corresponding essentially to that of said elements.

2. A watch spring bar bending tool comprising a plurality of concavely curved elements to be nested one within the other with a spring bar therebetween and constructed and arranged to bend said bar to a curved condition by pressing two of said curved elements toward one another and against the spring bar, and a gauge part connected to said concavely curved elements and having portions of predetermined different lengths for measuring spring bars of those different lengths respectively, said concavely curved elements being dimensioned to received between said elements, in a bending operation, the entire length of individual spring bars of said predetermined lengths.

3. A watch spring bar bending tool as recited in claim 2, in which there are three of said elements of progressively decreasing size and progressively decreasing radium of curvature and having laterally projecting portions connected movably together and to said gauge part.

4. A watch spring bar bending tool as recited in claim 3, in which each of the elements is of hemispherical configuration.

* * * * *